US005765088A

United States Patent [19]

Nakayama et al.

[11] Patent Number: 5,765,088

[45] Date of Patent: Jun. 9, 1998

[54] IMAGE FORMING APPARATUS AND CLEANING BLADE

[75] Inventors: Yasunori Nakayama, Gamagori; Shingo Hirota, Kobe; Kuniaki Kashiwakura, Toyohashi; Futoshi Okazaki; Kouji Matsushita, both of Toyokawa, all of Japan

[73] Assignee: Minolta Co., Ltd., Osaka, Japan

[21] Appl. No.: 858,577

[22] Filed: May 19, 1997

[30] Foreign Application Priority Data

May 20, 1996 [JP] Japan ..... 8-124995
Apr. 14, 1997 [JP] Japan ..... 9-095514

[51] Int. Cl.[6] ..... G03G 21/00

[52] U.S. Cl. ..... 399/350

[58] Field of Search ..... 399/350; 430/125; 15/256.5, 256.51

[56] References Cited

U.S. PATENT DOCUMENTS 5,040,030 8/1991 Ziegelmuller ..... 399/350

FOREIGN PATENT DOCUMENTS 0 284 447 A2 9/1988 European Pat. Off. .
62-164376 U 10/1987 Japan .
63-60477 3/1988 Japan .
1-105983 4/1989 Japan .
1-179972 7/1989 Japan .
1-214890 8/1989 Japan .
2-55270 U 4/1990 Japan .
3-20768 1/1991 Japan .
3-110589 10/1991 Japan .
4-194878 7/1992 Japan .
4-249285 9/1992 Japan .

*Primary Examiner*—Joan H. Pendegrass
*Attorney, Agent, or Firm*—Burns, Doane, Swecker & Mathis, LLP

[57] ABSTRACT

An image forming apparatus and a cleaning blade employed in the image forming apparatus which is operable to form an electrostatic latent image on an image carrying member, develop the latent image with toner into a visible toner image, transfer the toner image onto a record member and fix the same, and having an edge pressed against the image carrying member with a predetermined pressure for removing residual toner on the image carrying member after the transfer. A degree of toluene swelling of the cleaning blade is in a range from 20% to 100%, and the cleaning blade has an impact resilience in a range from 10% to 65%, a Young's modulus in a range from 30 to 120 kg/cm$^2$, and a 300%-modulus in a range from 100 to 600 kg/cm$^2$.

23 Claims, 11 Drawing Sheets

Counter Manner

Trailing Manner

IMAGE FORMING APPARATUS AND CLEANING BLADE

BACKGROUND OF THE INVENTION

1. Field of the Invention

The present invention relates to an electrophotographic image forming apparatus such as a copying machine, a facsimile, printer or the like, and in particular to an image forming apparatus provided with a cleaning device including a cleaning blade which is pressed against an image carrying member such as a photosensitive member or a dielectric member for removing toner remaining on the image carrying member after a toner image formed on the image carrying member is transferred onto a record medium or member. The invention also relates to the cleaning blade used in such an image forming apparatus.

2. Description of the Background Art

In an electrophotographic image forming apparatus such as a copying machine, a facsimile, a printer or the like, an electrostatic latent image is formed on an image carrying member such as a photosensitive member or a dielectric member, and then is developed into a toner image with developer containing toner. Usually, the toner image is transferred onto a record member such as a paper. In color image formation or the like, such a manner may be employed that the toner image formed on the image carrying member is transferred onto an intermediate transfer member such as an intermediate transfer belt, and then the toner image on the intermediate transfer member is transferred onto the record member. In this process, a majority of toner is transferred onto the record member, but a part of toner remains on the image carrying member. The residual toner is removed by a cleaning device to prevent disadvantages such as defects in images at next process of image formation.

Various types of cleaning devices have been proposed. For example, a cleaning device of a type using a cleaning blade operates in such a manner that an edge of the cleaning blade is pressed against an image carrying member to scrape off residual toner on the image carrying member.

In the cleaning device and the image forming apparatus in which the cleaning blade scrapes off the residual toner on the image carrying member, the cleaning may cause various problems and disadvantages such as abrasion or wearing, tear-off, turn-over and chattering of the cleaning blade as well as comet, abrasion of the image carrying member and noises. In order to overcome these problems and disadvantages, and also to improve a basic cleaning performance, the following proposals have been made.

For example, Japanese Laid-Open Patent Publication No. 1-105983 (105983/1989) has taught the following. A cleaning blade has a projection distance of about 8 mm, is formed of rubber having a rubber hardness of 65 to 70 degrees and an impact resilience of about 35% in a room temperature. In addition to this, the cleaning blade is pressed against the image carrying member with a pressure of 45 to 55 g/cm, and has a thickness of 2 to 3 mm. Thereby, the cleaning performance can be improved, and wearing of the image carrying member and the cleaning blade edge as well as noises can be suppressed.

In Japanese Laid-Open Patent Publication No. 1-179972 (179972/1989), a load value of a cleaning blade is determined by selection of two or more load determining members for improving lifetimes of the cleaning blade and photosensitive member.

Japanese Laid-Open Patent Publication No. 4-194878 (194878/1992) has proposed the followings. Control means is employed to bring a contact member into contact with an image carrying member with a predetermined pressure during removal of residual toner and with a predetermined pressure lower than the above predetermined pressure during non-operation. Thereby, early wearing of the image carrying member is prevented.

Japanese Laid-Open Patent Publication No. 4-249285 (249285/1992) has proposed as follows. A surface of a cleaning blade which is in contact with an image carrying member has such a roughness that a maximum height Rmax is in a range from 2 to 10 μm with respect to a reference length L (0.8 mm), so that wearing of the image carrying member can be small.

Japanese Laid-Open Patent Publication No. 3-110589 (110589/1991) has proposed as follows. Hydrophobic colloid silica is added as after-treatment agent to toner at a rate from 0.02 to 1% for improving a cleaning performance.

Japanese Laid-Open Patent Publication No. 1-214890 (214890/1989) has proposed as follows. A surface of a cleaning blade including at least an edge of the blade pressed against an image carrying member is provided with irregularities having a roughness of 1 μm or more but smaller than ½ of an average particle diameter of toner particle. Thereby, tear-off of the blade can be suppressed.

Japanese Laid-Open Patent Publication No. 3-20768 (20768/1991) has proposed as follows. An image carrying member is made of a material containing bisphenol Z-polycarbonate resin having a viscosity average molecular weight of $1.0\times10^4$ to $5.0\times10^4$. A cleaning blade is of a counter type made of polyurethane rubber having a hardness of JIS A60-70 degrees and a Young's modulus of 38 to 58 kgf/cm$^2$. The cleaning blade has a thickness of 1.5 to 2.0 mm, a projection length of 9 to 13 mm and a pressure of 1.3 to 1.9 g/cm against an image carrying member. Thereby, a good mechanical durability and a good application property of polycarbonate resin are maintained, noises due to wearing of the image carrying member and the cleaning blade is suppressed, and a cleaning performance can be improved.

European Patent Publication No. 284447 has proposed as follows. A cleaning blade has an edge of a roughness of 1 μm or less, or not larger than ½ of a toner particle diameter, whereby turn-over of the cleaning blade is prevented.

Japanese Laid-Open Utility Model Publication No. 2-55270 (55270/1990) has proposed a follows. A portion of a cleaning blade which is contact with an image carrying member has a surface roughness of 3 to 7 μmRz, whereby turn-over, chattering and comet can be prevented.

Japanese Laid-Open Utility Model Publication No. 62-164376 (164376/1987) has proposed as follows. At a position downstream to a cleaning member in a surface moving direction of an image carrying member, there is arranged a polishing member which is made of an elastic material containing an abrasive material and is in contact with the image carrying member. The abrasive material acts to remove matters adhered onto the image carrying member, so that a high image quality can be achieved for a long term.

Japanese Laid-Open Patent Publication No. 63-60477 (60477/1988) has proposed as follows. Hard and fine cleaner powder of 0.3 to 0.4 μm in size made of, e.g., polyvinylidene fluoride or polymethyl methacrylate is applied to an image carrying member. A substance forming a thin layer on the image carrying member together with this fine cleaner powder is removed by a cleaning member such as a cleaning blade, so that an image flow is prevented.

However, according to the proposals in Japanese Laid-Open Patent Publication Nos. 1-105983 and 4-249285, the edge of the cleaning blade may be worn to a large extent depending on characteristics of the toner, or due to variation in characteristic values of the cleaning blade other than the characteristic values described in these publications. As a result, failure in cleaning is liable to occur. This is particularly remarkable when an environmental humidity is high or a surface moving speed of the image carrying member is high.

According to the proposal of Japanese Laid-Open Patent Publication No. 3-110589, if the impact resilience of the cleaning blade is set to a low value for preventing turn-over of the cleaning blade, it is very difficult to obtain a sufficient cleaning performance.

According to the proposals of Japanese Laid-Open Utility-Model Publication No. 62-164376 and Japanese Laid-Open Patent Publication No. 63-60477, the surface of the image carrying member may be excessively worn or damaged depending on the characteristics of the image carrying member. If the cleaning blade is formed of an elastic material, the edge of the cleaning blade, which is in contact with the image carrying member, may be excessively worn, so that toner may partially remain without being wiped off, which reduces an image quality.

According to the proposals of Japanese Laid-Open Patent Publication Nos. 1-179972 and 4-194878 for suppressing wear of the image carrying members, a complicated mechanism is required for applying a pressure, and an extra space is required for the mechanism. Also, the mechanism increases a cost.

According to the proposal of Japanese Laid-Open Patent Publication No. 4-249285, it is necessary to control the surface roughness of the cleaning blade, which results in a low yield in manufacturing of the cleaning blades. When all the cleaning blades are required to having a surface roughness within a prescribed range in the manufacturing process, special processing is required, and the time and cost for manufacturing increase.

According to the proposals of Japanese Laid-Open Patent Publication No. 1-214890 and Japanese Laid-Open Utility Model Publication No. 2-55270 for preventing tear-off of the cleaning blades, buffing or the like may be employed to roughen the surface of the edge of the cleaning blade for providing an appropriate surface roughness. In this case, the prescribed surface roughness cannot be maintained due to reduction in irregularities at the surface when the edge is worn after a long use. Thereby, tear-off of the blade is liable to occur. This results in remarkable reduction in lifetime of the cleaning blade. When the cleaning blade containing small particles is employed, the prescribed surface roughness can be maintained even when the edge is worn after a long use. However, provision of the small particles at the blade increases a cost. Small particles separated from the blade due to wearing or the like of the edge may enter a developing device or the like, and thereby may adversely affect a developing performance or the like. In addition to the above, these publications do not refer to the fact that the edge of the cleaning blade pressed against the image carrying member is liable to be partially broken depending on physical characteristics of the cleaning blade and characteristics of the toner and others, although the proposal of these publication can suppress tear-off of the cleaning blade to a certain extent.

The proposals of Japanese Laid-Open Patent Publication Nos. 1-105983 and 3-20768 for preventing noises, suppression of noises cannot be performed independently the type of toner, and the noises cannot be suppressed when certain types of toner are to be scraped off by the cleaning blade. When the surface of the image carrying member is moving at a low speed with respect to the cleaning blade, and particularly when the image carrying member is stopping or an environmental humidity is high, noises are particularly liable to occur.

According to the proposal of European Patent Publication No. 284447, a special step is required for controlling the edge roughness.

SUMMARY OF THE INVENTION

Accordingly, the invention is aimed at provision of such a type of a cleaning blade provided in an image forming apparatus in which an electrostatic latent image is formed on an image carrying member, then is developed into a visible toner image with toner, and the toner image is transferred onto and fixed at a record member, particularly, a cleaning blade which is pressed against the image carrying member for removing residual toner on the image carrying member after the transfer. The invention is also aimed at provision of such a type of an image forming apparatus provided with above type of a cleaning blade. And more particularly, the invention is aimed at provision of such the above type of cleaning blade and the above type of image forming apparatus that the following one or more objects can be achieved.

A first object of the invention is to provide an image forming apparatus which can reduce a degree or amount of wear of an image carrying member due to friction with respect to a cleaning blade, and thereby can increase a lifetime of the image carrying member as well as a cleaning blade for providing such an image forming apparatus.

Another object of the invention is to provide an image forming apparatus which can suppress wearing of an image carrying member without requiring a special processing step and a special control step in a process of manufacturing a cleaning blade, and thereby can reduce a manufacturing cost, and is also to provide a cleaning blade for providing such an image forming apparatus.

Still another object of the invention is to provide an image forming apparatus which can suppress wearing of an image carrying member without requiring a mechanism of a complicated structure for pressing a cleaning blade against the image carrying member, and thereby can reduce a manufacturing cost, and is also to provide a cleaning blade for providing such an image forming apparatus.

Yet another object of the invention is to provide an image forming apparatus in which a cleaning blade can remove residual toner on an image carrying member to a practically sufficient extent, and is also to provide a cleaning blade for providing such an image forming apparatus.

Further another object of the invention is to provide an image forming apparatus which can suppress partial breakage of an edge of a cleaning blade as well as a cleaning blade for providing such an image forming apparatus.

A further object of the invention is to provide an image forming apparatus which can suppress wearing of a cleaning blade and an image carrying member as well as a cleaning blade for providing such an image forming apparatus.

The present invention provides an image forming apparatus which is operable to form an electrostatic latent image on an image carrying member, develop the latent image with toner into a visible toner image, transfer the toner image onto a record member and fix the same, and includes a cleaning device including a cleaning blade having an edge pressed against the image carrying member with a predetermined pressure for removing residual toner on the image carrying member after the transfer, wherein a degree of toluene swelling of said cleaning blade is in a range from 20% to 100%.

The invention also provides an image forming apparatus which is operable to form an electrostatic latent image on an image carrying member, develop the latent image with toner into a visible toner image, transfer the toner image onto a record member and fix the same, and includes a cleaning device including a cleaning blade having an edge pressed against the image carrying member with a predetermined pressure for removing residual toner on the image carrying member after the transfer, wherein the pressure of the cleaning blade against the image carrying member is in a range from 0.5 to 5 g/mm, the cleaning blade has an impact resilience in a range from 10 to 65%, the cleaning blade has a Young's modulus in a range from 30 to 120 kg/cm$^2$, and the cleaning blade has a 300%-modulus in a range from 100 to 600 kg/cm$^2$.

The present invention further provides a cleaning blade employed in an image forming apparatus which is operable to form an electrostatic latent image on an image carrying member, develop the latent image with toner into a visible toner image, transfer the toner image onto a record member and fix the same, and having an edge pressed against the image carrying member with a predetermined pressure for removing residual toner on the image carrying member after the transfer, wherein a degree of toluene swelling of said cleaning blade is in a range from 20% to 100%.

The present invention further provides a cleaning blade employed in an image forming apparatus which is operable to form an electrostatic latent image on an image carrying member, develop the latent image with toner into a visible toner image, transfer the toner image onto a record member and fix the same, and having an edge pressed against the image carrying member with a predetermined pressure for removing residual toner on the image carrying member after the transfer, wherein the cleaning blade has:

an impact resilience in a range from 10% to 65%, a Young's modulus in a range from 30 to 120 kg/cm$^2$, and a 300%-modulus in a range from 100 to 600 kg/cm$^2$.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
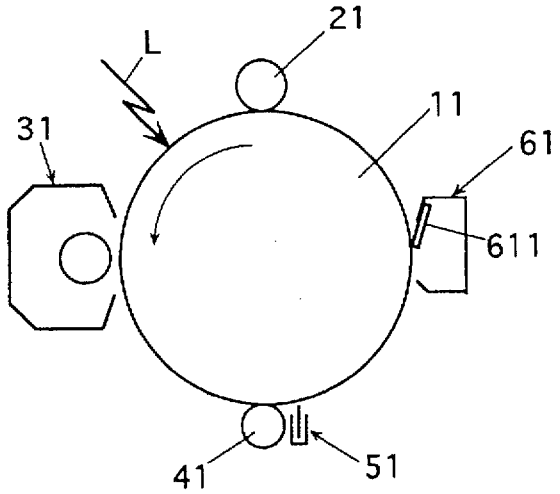
FIG. 1(A) shows a schematic structure of an example of an image forming apparatus according to the invention.
FIG. 1(B) is a cross section of a photosensitive drum.
Figure 1:
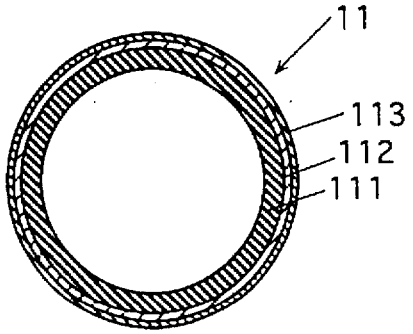

In an image forming apparatus of an embodiment of the invention as well as a cleaning blade used in the image forming apparatus, a degree of toluene swelling of the cleaning blade is in a range from 20% to 100%.

The degree of toluene swelling is determined by measuring a weight of a cleaning blade immediately after immersing the same into toluene for a constant time, and represents a ratio of increase of the weight with respect to that before immersion. The above degree of swelling is measured under the condition that the above constant time is 24 hours.

The degree of toluene swelling of the cleaning blade is determined in the foregoing range based on the finding from an experiment, which will be described later, that the degree in the above range can suppress the amount of wear of an image carrying member after $10^5$ rotations to 3 μm or less. When the amount of wear of the image carrying member after $10^5$ rotations is 3 μm or less, it can be considered that the image carrying member has a practically sufficient lifetime.

When the degree of toluene swelling is 100% or less, spaces between molecules of the cleaning blade material are small, so that a stick slip speed is low, and a vibration energy at an edge of the cleaning blade in contact with the image carrying member is suppressed. Thereby, wearing of the image carrying member can be suppressed.

The impact resilience of the cleaning blade may be in a range from 10% to 65% and more preferably in a range from 40% to 60%. This value of impact resilience of the cleaning blade is determined based on the finding from an experiment, which will be described later, that the above range can set the amount of wear after $10^5$ rotations of the image carrying member to 3 μm or less. This value of impact resilience was measured with an environment of a temperature of 25° C. and a humidity of 50% by a measuring method prescribed by Japanese Industrial Standards (JIS) K6255.

Owing to the small impact resilience of the cleaning blade from 10% to 65%, the stick slip speed can be low, and a vibration energy at the edge is suppressed, so that wearing of the image carrying member can be further reduced.

In any case, the pressure or pressing force of the cleaning blade against the image carrying member is preferably in a range from 0.5 to 5 g/mm. The following can be understood from an experiment which will be described later. If the pressure were smaller than 0.5 g/mm, it would be impossible to prevent remaining of toner, resulting in failure in cleaning and thus defects in images. If the pressure were larger than 5 g/mm, an excessively large friction force occurs between the cleaning blade and the image carrying member, so that wavy deformation and turn-over of the cleaning blade as well as partial breakage of the blade edge would be liable to occur, resulting in failure in cleaning and thus defects in images.

In an image forming apparatus as well as a cleaning blade used in the image forming apparatus of another embodiment of the invention, the pressure of the cleaning blade against the image carrying member is in a range from 0.5 to 5 g/mm, and the cleaning blade has an impact resilience in a range from 10% to 65 % (preferably, 40 to 60%), a Young's modulus in a range from 30 to 120 kg/cm$^2$ (preferably, 30 to 80 kg/cm$^2$), and a 300%-modulus in a range from 100 to 600 kg/cm$^2$ (preferably, 150 to 600 kg/cm$^2$).

The impact resilience of the cleaning blade is determined in the above range because this range can suppress wearing of the image carrying member and can maintain a practically sufficient cleaning performance, as can be understood from an experiment which will be described later. The value of the impact resilience is measured in the same manner as that already described.

The Young's modulus of the cleaning blade is determined in the above range because this range can suppress partial breakage of the edge of the cleaning blade pressed against the image carrying member, as can be understood from an experiment which will be described later.

The 300%-modulus of the cleaning blade is determined in the above range because this range can suppress wearing of the cleaning blade, and can also sufficiently suppress practically unallowed unwiping of toner, as can be understood from an experiment which will be described later. The 300%-modulus of the cleaning blade is a stress which is exerted on a section of the blade when an end of the blade is axially (i.e., in the direction opposed to the other end) pulled with the other end fixed, and therefore represents a stretch modulus. The value of 300%-modulus is measured by a measuring method prescribed by JIS.

In addition to the above conditions, it is preferable for the image forming apparatus and the cleaning blade of this embodiment that the cleaning blade has the following physical properties.

The degree of toluene swelling of the cleaning blade is preferably not higher than 100%, and more preferably 90% or less. This range of the degree of toluene swelling can suppress the wear of the image carrying member to a practically sufficient extent, as can be understood from an experiment which will be described later. In view of the cleaning performance, the degree of toluene swelling of the cleaning blade is preferably 20% or more, although not restricted thereto. The degree of toluene swelling is measured in the same manner as that already described.

The tension set or extension of the cleaning blade is preferably 5% or less, and more preferably 2% or less. This range of the tension set can prevent partial breakage of the edge of the cleaning blade pressed against the image carrying member, as can be understood from an experiment which will be described later. Such a situation that no tension set is present (i.e., tension set is 0%) does not occur, and the tension set is larger than 0% in any case.

The hardness of the cleaning blade is preferably in a range from 60 to 80 degrees. More preferably, it is in a range from 65 to 75 degrees. As can be understood from an experiment which will be described later, the hardness of 60 degrees or more can suppress generation of noises to a practically allowed extent, and the hardness of 80 degrees or less can achieve a practically required cleaning performance including prevention of unwiping of the residual toner. The hardness was measured with a plurality of cleaning blades forming a stack of about 12 mm in thickness under an environment that a temperature is 25° C. and a humidity is 50%. For this measurement, a rubber hardness meter of JIS A-type was used, and a load of 1000 grams was vertically applied to the stack.

The tensile strength of the cleaning blade is preferably in a range from 100 to 600 kg/cm$^2$. More preferably, it is in a range from 100 to 450 kg/cm$^2$. As can be understood from an experiment which will be described later, the tensile strength in this above range can suppress wearing of the cleaning blade and partial breakage of the cleaning blade edge, can prevent unwiping of the toner and can achieve good cleaning for an increased period.

The cleaning blade preferably has a thickness of 1 mm or more, and more preferably, 1.5 mm or more. As can be understood from an experiment which will be described later, a thickness of 1 mm or more can achieve a practically allowed cleaning performance. The upper limit of the cleaning blade, which is determined in view of an installation space or the like, is about 2 mm, although not restricted thereto.

An angle of pressing of the cleaning blade against the image carrying member is preferably in a range from 5 to 20 degrees. More preferably, it is in a range from 7 to 15 degrees. As can be understood from an experiment which will be described later, if this pressing angle were smaller than 5 degrees, a suppressing force against the toner would be remarkably reduced, and the toner would be likely to move through a space between the cleaning blade and the image carrying member. If it were larger than 20 degrees, tear-off of the blade would be likely to occur, and the toner would be likely to move through the above space.

The toner adhering to the image carrying member is preferably as that, of which an average particle diameter is preferably in a range from 3 to 15 μm (more preferably, from 3 to 12 μm) and of which an absolute value of the charge amount is preferably in a range from 5 to 50 μC/g (more preferably, from 10 to 40 μC/g). Generally available toner have these characteristics. If the average particle diameter of the toner were smaller than 3 μm, it would be extremely difficult to scrape off the toner by the cleaning blade, resulting in failure in cleaning and defects in images. If the average particle diameter of the toner were larger than 15 μm, the image quality would decrease to a practically unallowed level. If the absolute value of the charge amount of the toner were smaller than 5 μC/g, the toner would disperse excessively, which would cause toner fogging on images and/or smear the image forming apparatus. If the absolute value of charge amount of the toner were larger than 50 μC/g, the development property would be impaired, resulting in an insufficient and therefore impractical image density.

If the toner contains after-treatment agent added thereto, the average particle diameter of the after-treatment agent is preferably in a range from 5 to 50 nm, and more preferably in a range from 10 to 40 nm. The after-treatment agent is added to the toner for improving, e.g., flowability of the toner. The after-treatment agent may be, for example, silicon dioxide or aluminum oxide. As can be understood from an experiment which will be described later, the above range of the average particle diameter of the after-treatment agent can suppress adhesion of foreign matters (such as a film and/or spots of the after-treatment agent component) onto the surface of the image carrying member.

Tear-off of the cleaning blade generally occurs due to the fact that the edge of the cleaning blade does not smoothly slide on the surface of the image carrying member. However, tear-off of the blade is also affected significantly by a force exerted by the cleaning blade to the image carrying member, i.e., a force caused by sliding between the cleaning blade and the image carrying member and acting on the blade to tear off or turn over the blade. Assuming that the cleaning blade has a length L (cm), a force exerted on the image carrying member may be in a range from 0.005L to 0.057L (kg), and more preferably from 0.005L to 0.04L (kg), in which case tear-off of the cleaning blade can be suppressed. The above blade length L (cm) is a length of a portion of the cleaning blade which is in actual contact with the image carrying member and extends across the surface moving direction of the image carrying member. In the case where the image carrying member has a drum form, it can be expressed as a shaft torque. Assuming that the drum radius is r (cm), the shaft torque is preferably in a range from 0.005L·r to 0.057L·r (kg·cm) and more preferably from 0.005L·r to 0.04L·r (kg·cm), in which case tear-off of the cleaning blade is suppressed.

The foregoing can be expressed with numerical values as follows. For example, a torque exerted on the image carrying member of a rotary type is preferably not larger than 10 kg·cm, and more preferably not larger than 7 kg·cm.

The image carrying member employed in the image forming apparatus of the invention (or the image carrying member against which the cleaning blade of the invention is pressed) may be, for example, a photosensitive member or a dielectric member. The photosensitive member may be selected from known photosensitive members such as various kinds of organic photosensitive members, arsenic selenide photosensitive member, tellurium selenide photosensitive member, selenium photosensitive member, CdS photosensitive member and amorphous silicon photosensitive member. The dielectric member may have, for example, a surface layer made of dielectric resin such as polycarbonate, polyurethane, polyimide, polyamide, polyester, acetate, acrylic resin or polyethylene. In any case, the image carrying member may have a drum form, a belt form or the like.

The cleaning blade employed in the image forming apparatus of the invention (or the cleaning blade according to the invention) must be made of a material having high resistances against abrasion, ozone, toner and chemical attack (i.e., low reactivity with respect to the image carrying member) as well as a high workability. Such a material may be polyurethane resin (e.g., polyurethane rubber) or polytetrafluoroethylene, but is not restricted thereto.

A manner of pressing the cleaning blade employed in the image forming apparatus of the invention against the image carrying member (or a manner of pressing the cleaning blade according to the invention against the carrying member) may be either a counter type or a trailing type.

Embodiments of the invention will be described below with reference to the drawings.

FIG. 1(A) shows a schematic structure of an example of an image forming apparatus according to the invention.

This apparatus is provided with a photosensitive member 11 of a drum form employed as an image carrying member, which is driven to rotate counterclockwise in the figure, and also provided with a charging roller 21 employed as a charging device, a developing device 31, a transfer roller 41 employed as a transfer device, a discharging probe 51 employed as a discharging and separating device for a record member, and a cleaning device 61, which are arranged in this order around the photosensitive member 11.

The charging roller 21 is connected to a power source (not shown) which can superpose a negative DC voltage on an AC voltage, so that the surface of the photosensitive drum 11 can be charged to a negative potential.

Record image light L is radiated to a region at the surface of the photosensitive member 11, which is uniformly charged by the charging roller 21, through a space between the charging roller 21 and the developing device 31. If the image forming apparatus is an analog copying machine, the light L is reflected light which is reflected by an original image and is guided by an optical scanning system including an illumination lamp, reflection mirrors and focusing lenses. If the image forming apparatus is a digital copying machine, an original image read by the optical scanning system is photoelectrically converted by an image sensor such as a CCD, and is temporarily stored in storage means such as a memory. Based on data thus stored in the storage means, the light L is radiated by an exposure device including, e.g., a semiconductor laser. If the image forming apparatus is a printer or a facsimile, the light L is radiated by an exposure device including, e.g., a semiconductor laser based on an image data sent from a host device such as a computer connected to the printer or facsimile.

In this embodiment, the photosensitive drum 1 is an organic photosensitive member (OPC), and is formed of a cylindrical aluminum tube 111, over which a charge generating layer 112 of 1 μm or less in thickness made of bis-azo pigment and binder resin, and a charge transporting layer 113 of about 23 μm in thickness made of hydrazone derivative and polycarbonate resin are layered in this order (see FIG. 1(B)).

The developing device 31 can form a visible image on the photosensitive drum 11, which is negatively charged by the charging roller 21, from an electrostatic latent image formed by radiation of the record image light L with charged powder or particles accommodated in the developing device 31. In this embodiment, the electrostatic latent image can be visualized by a two-component dry developing method using positively charged non-magnetic toner powder and magnetic carrier. The developing device is not restricted to the above two-component dry developing type, and may be of a one-component dry developing type using only toner powder, or a wet developing type using ink or using isoper and pigment particles dissolved thereinto.

Figure 20A:
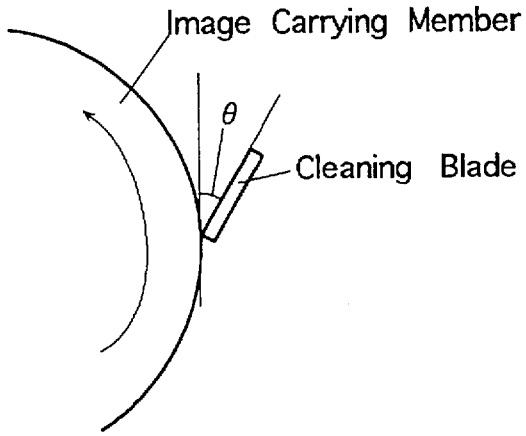
FIGS. 20(A) and 20(B) show methods of bringing a cleaning blade into contact with an image carrying member, and specifically show a counter method and a trailing method, respectively.
Figure 20B:
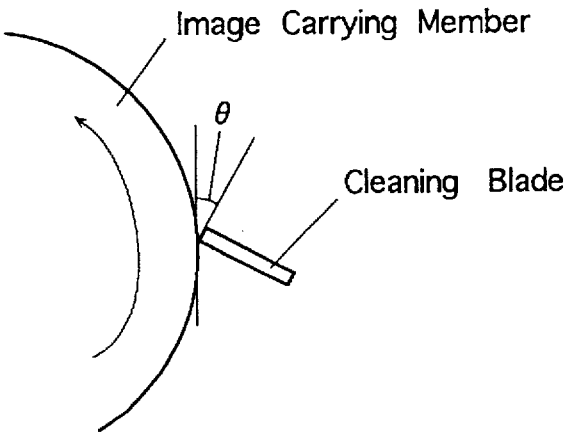

The cleaning device 61 is provided with a cleaning blade 611, which is made of polyurethane resin in this embodiment and has an edge pressed against the photosensitive drum 11. The edge of the cleaning blade 611 is in contact with the photosensitive drum 11 in a counter manner. In the counter method, the cleaning blade is in contact with the image carrying member in the manner shown in FIG. 20(A). As another method, there is a trailing method shown in FIG. 20(B).

In this image forming apparatus, the surface of the photosensitive drum 11 which is rotated counterclockwise in FIG. 1(A) is uniformly and negatively charged by the charging roller 21. An electrostatic latent image corresponding to record image light L is formed by radiation of the record image light L onto the photosensitive drum 11 thus charged. The electrostatic latent image is converted into a toner image by the developing device 31, and is transferred by the transfer roller 41 onto a record member such as a paper supplied by record member supply device (not shown). The record member bearing the transferred toner image is separated by the discharging probe 51 from the photosensitive drum 11, and then is discharged from the apparatus after the toner image is fixed onto the record member by a fixing device (not shown).

The toner which was not transferred onto the record member and remains on the photosensitive drum 11 is removed by the cleaning device 61 for preventing adverse influence in a subsequent image forming process. A pattern and others which are formed on the photosensitive drum 11 for adjusting an image are not transferred onto the record member, and are removed by the cleaning device 61. For removal of the toner, the cleaning blade 611 is pressed at its edge against the surface of the photosensitive drum 11 for scraping off the residual toner by the edge.

Experiments were performed with image forming apparatuses of the type shown in FIG. 1 for determining relationships relating to physical properties and others of the cleaning blades, cleaning performances, and amounts of wear of the cleaning blades and the photosensitive member. The contents and results of the experiments will be described below.

(A) Pressure of Cleaning Blade

A pressure or pressing force of the cleaning blade against the photosensitive member exerts a large influence on a performance of scraping off the residual toner. Accordingly, an experiment was performed to determine the cleaning performance by varying a pressure of the cleaning blade against the photosensitive drum.

This experiment was performed with residual toner having an average particle diameter of 8 μm, and an absolute value of charge amount of 20 μC/g.

A result of the experiment is shown in the following table 1.

TABLE 1

| Pressure (g/mm) | | | | | | | |
|---|---|---|---|---|---|---|---|
| 0.4 | 0.8 | 1.6 | 2.0 | 3.2 | 4.4 | 4.8 | 5.2 |
| X (unwiping) | O | O | O | O | O | O | X (tear-off) |

In the table 1, the mark "O" represents that good cleaning was performed without unwiping of toner. The mark "X" at the pressure of 0.4 g/mm represents that the toner was partially unwiped. The mark "X" at the pressure of 5.2 g/mm represents that the cleaning blade was torn off.

It can be understood from the table 1 that the pressure larger than about 0.4 g/mm can suppress remaining of the toner to a practically sufficient extent However, tear-off of the blade and therefore unwiping of the toner occurred with the pressure of 5.2 g/mm. Even if the pressure is larger than about 0.4 g/mm, unwiping of the residual toner is liable to occur with the pressure of an excessively large value which may lose the elasticity at the edge of the cleaning blade in contact with the photosensitive drum. If the pressure exceeds about 5 g/mm, corrugation or wavy deformation of the cleaning blade and/or partial breakage of the edge may occur and thus cause a failure in cleaning. Also, sliding between the blade and the photosensitive drum may cause noises, and a drive torque for rotating the photosensitive drum may increase excessively, so that a failure in driving may occur. These are already confirmed by the inventors.

Accordingly, the pressure of the cleaning blade is preferably in a range from 0.5 to 5.5 g/mm from the viewpoint of the cleaning performance and others.

(B) Pressing Angle of Cleaning Blade

The pressing angle of the cleaning blade with respect to the photosensitive drum significantly affects the performance of scraping off the residual toner. Accordingly, an experiment was performed for determining the cleaning performance with various values of the pressing angle between the cleaning blade and the photosensitive drum.

This pressing angle is an angle θ which is measured at the position of contact between the photosensitive drum and the blade, and is defined between tangent line on the surface of photosensitive drum and the blade surface opposed to the surface of the photosensitive member at the downstream side in the surface moving direction of the photosensitive member. The above manner of measuring and defining the angle do not depend on the manner (i.e., counter manner in FIG. 20(A), or trailing manner in FIG. 20(B)) of contact of the cleaning blade with the photosensitive drum (image carrying member).

This experiment was performed with the residual toner of an average particle diameter of 8 μm and an absolute value of charge amount of 20 μC/g.

A result of the experiment is shown in the following table 2.

TABLE 2

| Pressing Angle θ (degrees) | | | | | | |
|---|---|---|---|---|---|---|
| 3 | 5 | 8 | 11 | 15 | 18 | 22 |
| X (unwiping) | O | O | O | O | O | X (tear-off) |

In the table 2, the mark "O" represents that good cleaning was performed without unwiping of toner. The mark "X" at the pressing angle of 3 degrees represents that the toner was partially unwiped. The mark "X" at the pressing angle of 22 degrees represents that the cleaning blade was torn off.

It can be understood from the table 2 that the pressing angle of 3 degrees caused the unwiping of toner. The reason for this can be considered as follows. If the pressing angle is smaller than about 5 degrees, not only the edge of the cleaning blade but also the middle portion thereof are pressed against the photosensitive drum, resulting in remarkable lowering of the performance of preventing the toner. It can be seen that the pressing angle of 22 degrees caused the tear-off of the cleaning blade. The reason for this is considered that the pressing angle exceeding about 20 degrees causes a large stress in the direction of tear-off or turn-over of the cleaning blade.

Accordingly, it can be understood that the pressing angle of the cleaning blade is in a range from 5 to 20 degrees, and more preferably from 7 to 15 degrees from the viewpoint of the cleaning performance or the like.

(C) Impact Resilience of Cleaning Blade (C-1) An experiment was performed for determining a pressure, at which 50%-unwiping of the residual toner starts, with various values of the impact resilience of the cleaning blade at a room temperature. The 50%-unwiping start pressure is a pressure of the blade at which a rate of the unwiped residual toner reaches 50% when decreasing the pressure of the cleaning blade against the photosensitive member. The 50%-unwiping start pressure of 1.5 g/mm or less causes no practical problem.

This experiment was performed under the conditions that the cleaning blade pressing angle is 10 degrees, the residual toner have an average particle diameter of 8 μm, the absolute value of charge amount of the residual toner is about 20 μC/g and the after-treatment agent is added to the toner at 0.5 weight %. The impact resilience of the cleaning blade was varied by selecting various kinds of materials of polyurethane such as adipate-contained and caprolactam-contained materials, and (or) by changing the manufacturing methods and conditions.

Figure 2:
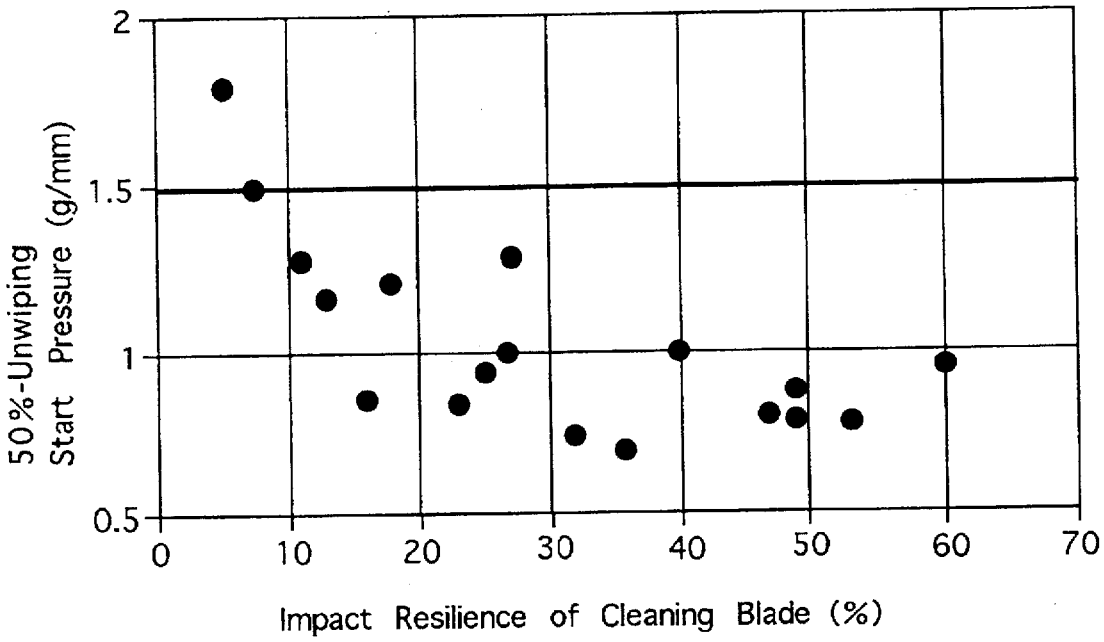
FIG. 2 shows a result of an experiment for determining a relationship between an impact resilience of a cleaning blade and a start pressure of 50%-unwiping.

A result of the experiment is shown in FIG. 2. It can be understood that when the impact resilience was 10% or more, the 50%-unwiping start pressure was smaller than 1.5 g/mm, and unwiping did not cause a practical problem. It can also be understood that the impact resilience of 25% or more reduced variation in 50%-unwiping start pressure with respect to the impact resilience, and thus reduced variation in cleaning performance, resulting in a stable cleaning performance. When the impact resilience was 40% or more, variation of 50%-unwiping start pressure with respect to the impact resilience decreased. The reason for this can be considered as follows. As the impact resilience of the cleaning blade increases, a restoring force of the edge of the cleaning blade increases, so that it can be in contact with the photosensitive member for an increased time, and therefore unwiping is suppressed to a sufficient extent. If the impact resilience is smaller than 10%, the flexibility and restorability are impaired and a basic function of wiping off the toner is impaired so that the blade cannot be practically used. However, the impact resilience more than 65% excessively improves the cleaning performance, so that tear-off of the cleaning blade is very liable to occur.

(C-2) An experiment was performed for determining an amount of wear of the photosensitive member with various values of the impact resilience of the cleaning blade at the room temperature. During cleaning, the photosensitive member is worn due to a friction between the cleaning blade and the photosensitive member of which surface is moving (in the case that the photosensitive member of drum form is employed like in this embodiment, the surface moves in accordance with rotation of the drum). The wear or abrasion of the photosensitive member is an important factor determining a lifetime of the photosensitive member. Therefore, less wear is usually more preferable. In particular, a large wear exceeding 3 μm after $10^5$ rotations of the photosensitive drum causes a problem in the product quality.

This experiment was performed to determine the amount of wear after $10^5$ rotations of the photosensitive drum under the conditions that the pressure of the cleaning blade was 2.0 g/mm, the charge amount of residual toner was about 10 μC/g and the degree of toluene swelling of the cleaning blade was 90%. The impact resilience of the cleaning blade was varied by selecting various kinds of materials of polyurethane such as adipate-contained and caprolactam-contained materials, or by changing the manufacturing methods and conditions.

Figure 3:
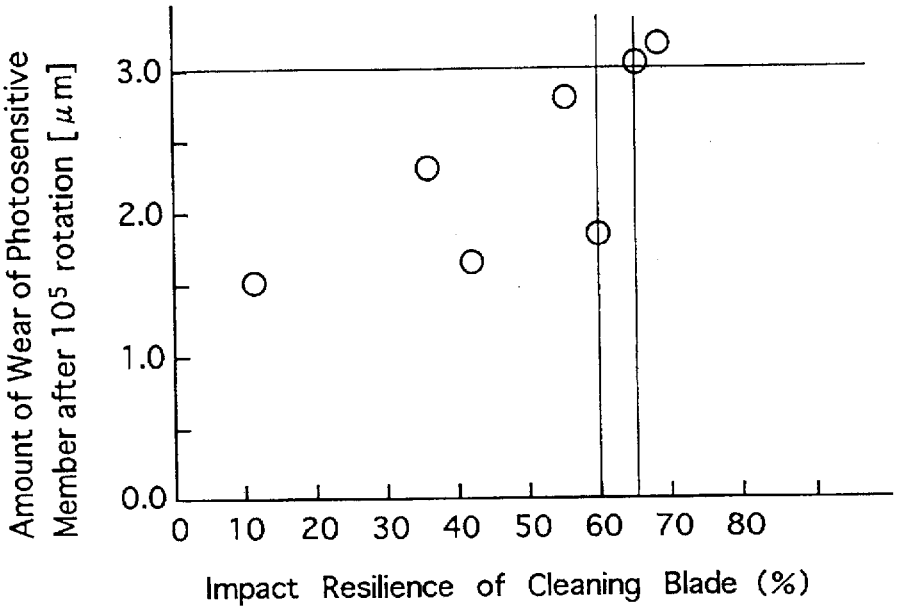
FIG. 3 shows a result of an experiment for determining a relationship between an impact resilience of a cleaning blade and an amount wear of a photosensitive member.

A result of the experiment is shown in FIG. 3. It can be understood from FIG. 3 that the cleaning blade having the impact resilience of 65% or less, and more preferably 60% or less could suppress the amount of wear after $10^5$ rotations of the photosensitive drum to 3.0 μm or less, which did not cause a practical problem. Thus, the impact resilience of the blade of 65% or less (preferably, 60% or less) could ensure a practically sufficient lifetime of the photosensitive drum, and did not cause a problem in the product quality. The reason for this can be considered as follows. Since spaces between molecules of the cleaning blade material are small, a stick slip speed is low, and a vibration energy at the edge is suppressed. Thereby, wearing of the photosensitive drum can be small. The "stick slip speed" is a speed of vibration of an extremely small portion which is intermittently stuck and thereby intermittently moves when smooth sliding does not occur. With the impact resilience of 5% or less, the photosensitive member is not adversely affected, but the cleaning blade material loses the flexibility and restorability, so that a basic function of cleaning the residual toner is impaired to a practically unsuitable extent.

From the results of the above two experiments, the impact resilience of the cleaning blade is substantially in a range from 10 to 65%, and more preferably from 40 to 60% from the viewpoint of suppression of wear of the photosensitive member and the cleaning performance.

(D) Young's Modulus of Cleaning Blade

An experiment was performed for determining a situation of occurrence of partial breakage, which occurred at the edge of the cleaning blade in contact with the photosensitive member, with various values of Young's modulus of the cleaning blade.

This experiment was performed with the charge amount of the residual toner selectively set to 5 μC/g, 10 μC/g and 15 μC/g. In either case, the pressure of the cleaning blade was 2 g/mm and the pressing angle thereof was 10 degrees.

Figure 4:
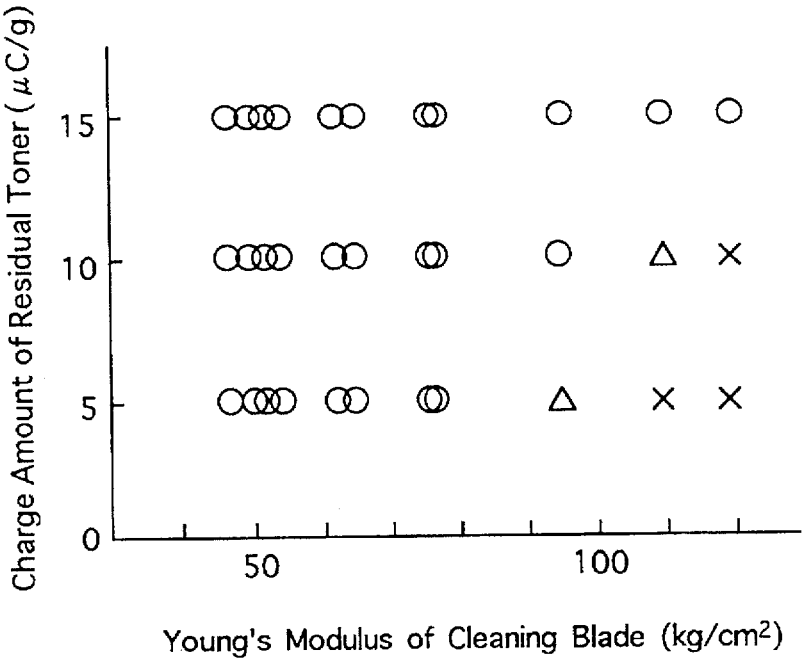
FIG. 4 shows a result of an experiment for determining a relationship between a Young's modulus of a cleaning blade and a situation of occurrence of partial breakage of the blade edge.

A result of the experiment is shown in FIG. 4. In FIG. 4, circular marks represent that partial breakage of the edge did not occur, triangular marks represent that minutely partial breakage of the edge occurred, and "X" marks represent that non-minute partial breakage occurred. It can be understood from the result that a larger Young's modulus tends to cause the partial breakage. The reason for this can be considered as follows. Since the Young's modulus can be considered to represent the hardness, a larger Young's modulus of the cleaning blade increases the hardness of the blade but makes the blade more fragile. From this result of experiment, it can be understood that the Young's modulus of the cleaning blade is preferably in a range from 30 to 120 kg/cm$^2$, and more preferably from 30 to 80 kg/cm$^2$ from the viewpoint of suppression of the partial breakage of the edge of the cleaning blade.

(E) 300%-Modulus of Cleaning Blade

An experiment was performed to determine a relationship between the amount of wear of the blade edge and occurrence of unwiping of the toner with various values of the 300%-modulus of the cleaning blade at the room temperature.

In this experiment, an image forming apparatus of the type shown in FIG. 1 was used as a copying machine operating at a copying speed of 76 sheets per minute, and a worn sectional area of the blade edge and occurrence of unwiping of the toner were determined after copying of $10^5$ A4-size sheets. The worn sectional area was measured by observing the surface of the blade edge with a scanning electron microscope. The experiment was performed under the conditions that after-treatment agent added to the toner had a particle diameter of 50 nm, the temperature was 25° C., and the relative humidity was 50%. The blade pressure against the photosensitive member was selectively set to 0.5 g/mm, 3.0 g/mm and 5.0 g/mm. The 300%-modulus of the cleaning blade was varied by selecting various kinds of materials of polyurethane such as adipate-contained and caprolactam-contained materials, and (or) by changing the manufacturing methods and conditions.

Figure 5:
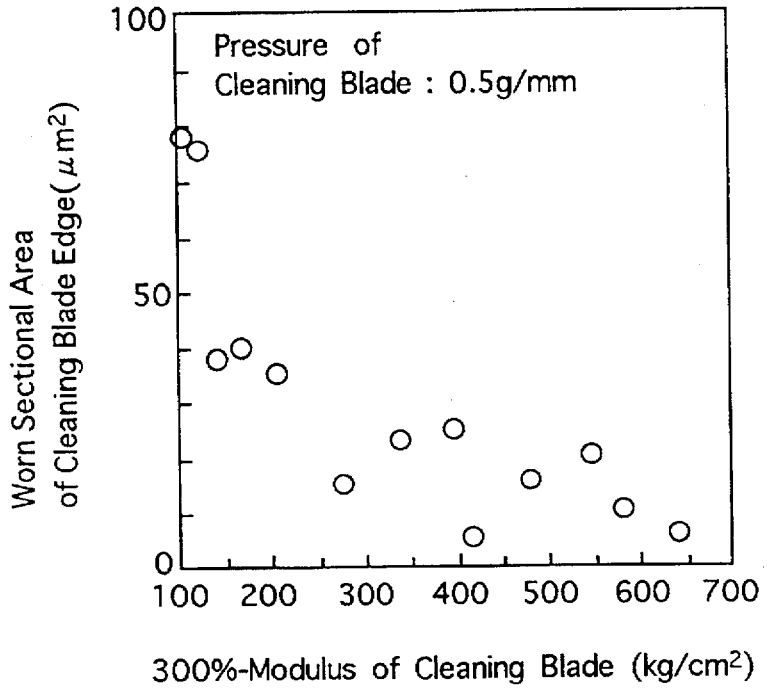
FIG. 5 shows a result of an experiment for determining a relationship between a 300%-modulus of a cleaning blade, a degree of wear of a blade edge and a situation of occurrence of unwiping of toner in the case where a pressure of the cleaning blade is 0.5 g/mm.
Figure 6:
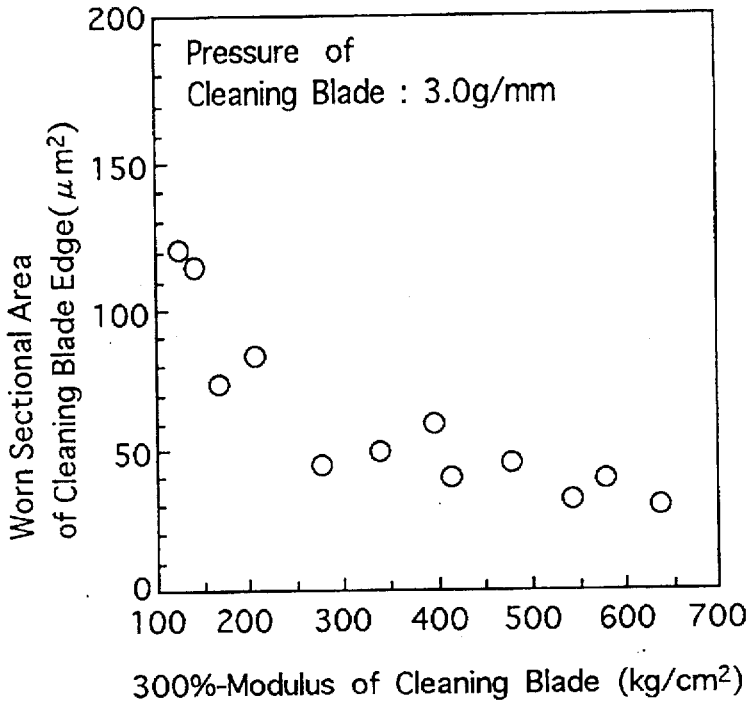
FIG. 6 shows a result of an experiment for determining a relationship between a 300%-modulus of a cleaning blade, a degree of wear of a blade edge and a situation of occurrence of unwiping of toner in the case where a pressure of the cleaning blade is 3.0 g/mm.
Figure 7:
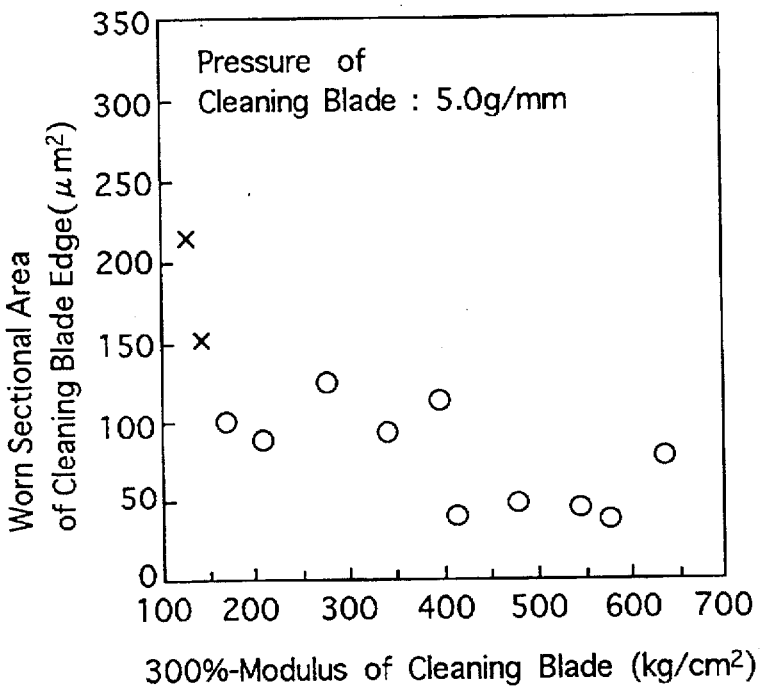
FIG. 7 shows a result of an experiment for determining a relationship between a 300%-modulus of a cleaning blade, a degree of wear of a blade edge and a situation of occurrence of unwiping of toner in the case where a pressure of the cleaning blade is 5.0 g/mm.

The results are shown in FIGS. 5, 6 and 7. FIG. 5 shows the result at the blade pressure of 0.5 g/mm. FIG. 6 shows the result at the blade pressure of 3.0 g/mm. FIG. 7 shows the result at the blade pressure of 5.0 g/mm. In FIGS. 5 to 7, "O" represents that the amount of unwiped toner caused no practical problem. The mark "X" represents that the amount of unwiped toner caused a practical problem.

It can be understood from these figures that the 300%-modulus in a range from 100 to 640 kg/cm$^2$ did not cause unwiping of the toner when the pressure of the cleaning blade against the photosensitive member was 0.5 g/mm. When the pressure was 3.0 g/mm, the 300%-modulus in a range from 120 to 640 kg/cm$^2$ did not cause unwiping of the toner. When the pressure was 5.0 g/mm, the 300%-modulus in a range from 160 to 640 kg/cm$^2$ did not cause unwiping of the toner, but the pressure of 140 kg/cm$^2$ or less caused unwiping of the toner.

It can also be understood that the worn sectional area of the blade edge decreased with increase in 300%-modules of the cleaning blade at the room temperature. Therefore, it can be considered as follows. Even when the blade edge is likely to deform to a large extent, for example, when the charge amount of the residual toner is small due to a high environmental humidity, so that an adhesion force of the toner to the photosensitive member is small, or when the surface moving speed of the photosensitive member is high, wear of the edge can be suppressed by increasing the 300%-modulus of the blade.

Although not shown in FIGS. 5 to 7, when the 300%-modulus was 650 kg/cm$^2$ or more, unwiping of the toner in a striped form occurred due to chipping wear of the cleaning blade even at the initial stage of the continuous copying. The reason for this can be considered as follows. Since the 300%-modules was excessively large, normal wearing was unlikely to occur when the blade edge significantly deformed, resulting in the chipping wear, i.e., tear-off of portions of the blade at which soft segments are concentrated.

Therefore, it can be understood that, when the pressure was 5.0 g/mm or less, the 300%-modulus of the cleaning blade is preferably in a range from 100 to 600 kg/cm$^2$, and more preferably in a range from 150 to 600 kg/cm$^2$ from the viewpoint of the cleaning performance and suppression of friction of the blade edge.

(F) Degree of Toluene Swelling of Cleaning Blade

An experiment was performed for determining the amount of wear after $10^5$ rotations of the photosensitive member with various values of the degree of toluene swelling of the cleaning blade at the room temperature.

In this experiment, the amount of wear after $10^5$ rotations of the photosensitive drum was measured under the conditions that the pressure of the cleaning blade against the photosensitive drum was 2.0±0.2 g/mm, the charge amount of the residual toner was about 10 μC/g and the impact resilience of the cleaning blade was about 50%. The degree of toluene swelling of the cleaning blade was varied by selecting various kinds of materials of polyurethane such as adipate-contained and caprolactam-contained materials, and (or) by changing the manufacturing methods and conditions.

Figure 8:
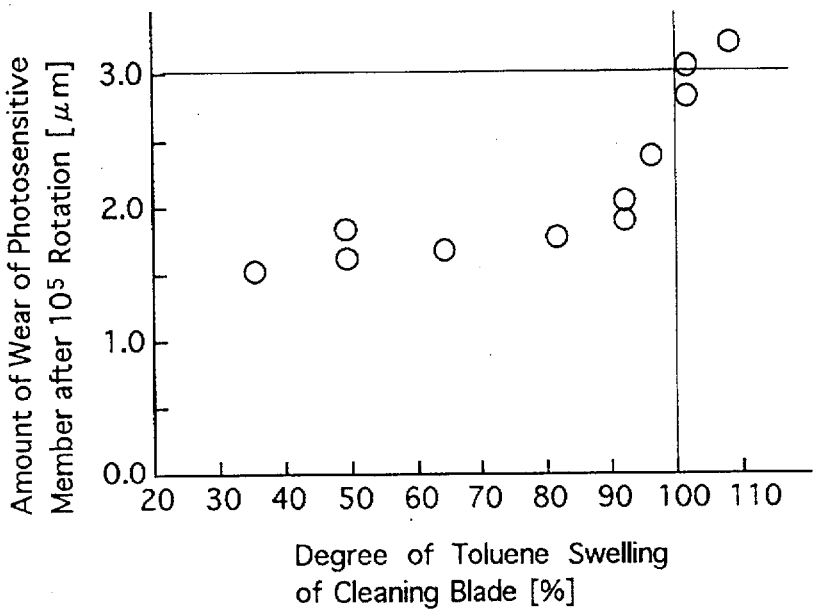
FIG. 8 shows a result of an experiment for determining a relationship between a degree of toluene swelling of a cleaning blade and an amount of wear of a photosensitive member.

The result of experiment is shown in FIG. 8. According to this result, if the degree of toluene swelling of the cleaning blade is 100% or less in view of deviation, the amount of wear after $10^5$ rotations of the photosensitive drum is 3.0 μm or less. Therefore, by setting the degree of toluene swelling to 100% or less, the amount of wear can be suppressed to a practically allowed extent, and in other words, the photosensitive drum can have a practically sufficient lifetime, so that no problem arises in the product quality. The reason for this can be considered as follows. When the degree of toluene swelling of the cleaning blade is 100% or less, spaces between molecules of the cleaning blade material are small, so that a stick slip speed is low, and a vibration energy of an edge of the cleaning blade in contact with the photosensitive member is suppressed. Thereby, wearing of the photosensitive member can be suppressed. When the degree of toluene swelling is lower than 20%, the photosensitive member is not adversely affected, but the cleaning blade material loses the flexibility and restorability, so that a basic function of cleaning the residual toner is impaired to an unpractical extent. In the prior art, the degree of toluene swelling of the cleaning blade is scarcely controlled, and may exceed 100% in many cases, so that the photosensitive member is worn to a large extent due to this. When a material lot or the like is changed, the degree of toluene swelling varies. Therefore, the degree of toluene swelling of 90% or less is more preferable for achieving a stable amount of wear.

Although a larger pressure generally increases an amount of wear of the photosensitive member, a point at which the amount of wear of the photosensitive member increases to an unpreferable value (larger than 3 μm) does not change significantly with change in degree of the toluene swelling, when the pressure is in a practical range from 0.5 to 5 g/mm. According to this consideration, it can be considered that when the pressure is in the practical range from 0.5 to 5 g/mm, results are similar to that shown in FIG. 8.

Figure 9:
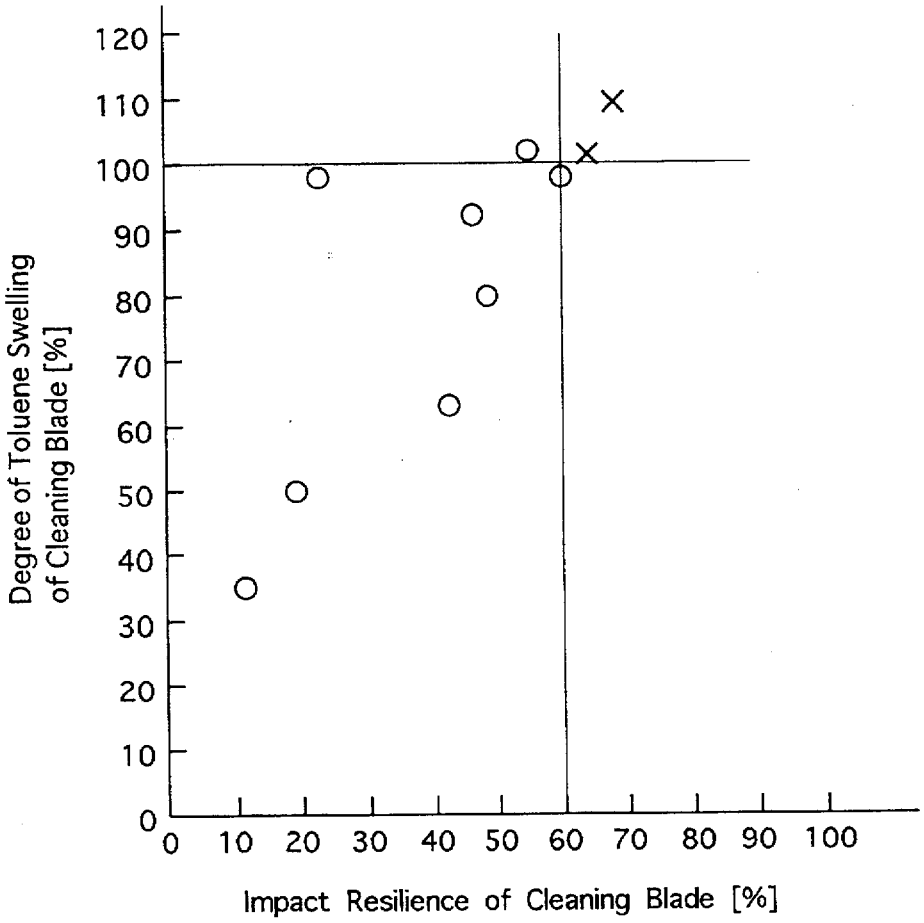
FIG. 9 shows a result of an experiment for determining a relationship between an impact resilience of a cleaning blade, a degree of toluene swelling thereof and an amount of wear of a photosensor member.

FIG. 9 shows a result of an experiment in which the amount of wear of the photosensitive drum after $10^5$ rotations was determined with various values of the degree of toluene swelling and the impact resilience of the cleaning blade at the room temperature. In this experiment, the amount of wear after $10^5$ rotations was determined under the conditions that the pressure of the cleaning blade is 2.0 g/mm and the charge amount of the residual toner is about 10 μC/g. In FIG. 9, "O" represents that the amount of wear after $10^5$ rotations was 3.0 μm or less, and "X" represents that the amount of wear after $10^5$ rotations exceeded 3.0 μm.

From the figure, it can be understood as follows. When the degree of toluene swelling of the cleaning blade is 100% or less and the impact resilience is 60% or less, the amount of wear after $10^5$ rotations of the photosensitive drum is in a practically allowed range not exceeding 3.0 μm.

Therefore, in view of the cleaning performance and the suppression of wear of the photosensitive member, the suitable degree of toluene swelling of the cleaning blade is substantially in a range from 20 to 100%.

(G) Tension Set of Cleaning Blade

An experiment was performed to determine a situation of occurrence of partial breakage of the blade edge with various values of the tension set of the cleaning blade.

This experiment was performed in three cases in which the charge amount of toner was 5 μC/g, 10 μC/g and 15 μC/g, respectively. In all the cases, the pressure of the cleaning blade was 2 g/mm, and the pressing angle of the blade was 10 degrees.

Figure 10:
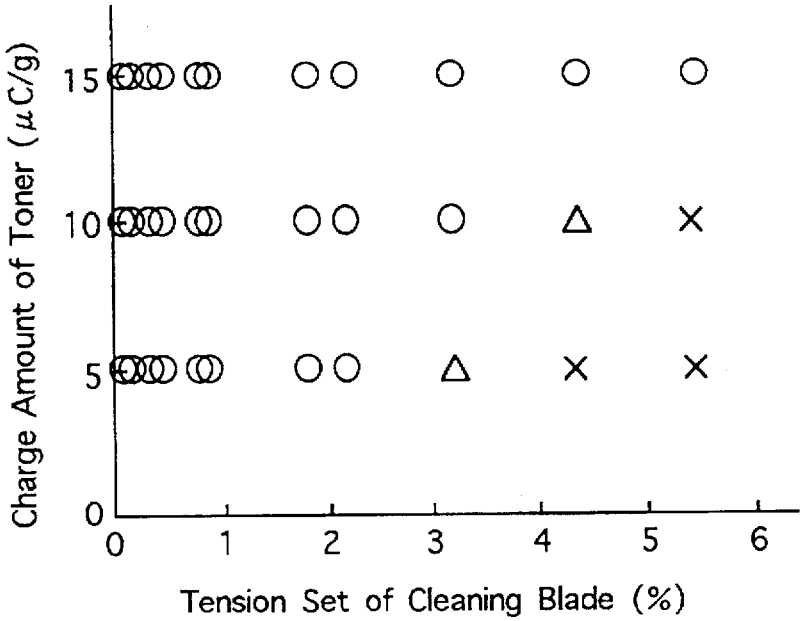
FIG. 10 shows a result of an experiment for determining a relationship between a tension set of a cleaning blade and a situation of occurrence of partial breakage of a blade edge.

A result of the experiment is shown in FIG. 10. In FIG. 10, circular marks represent that partial breakage of the edge did not occur, triangular marks represent that minutely partial breakage of the edge occurred, and "X" marks represent that non-minute partial breakage occurred. It can be understood from the figure that the partial breakage of the edge is more likely to occur with increase in tension set of the cleaning blade. The reason for this can be considered as follows. As the tension set of the cleaning blade increases, the intermolecular bonding force of the blade material excessively decreases, so that wearing of the blade edge which is significantly deformed cannot be suppressed.

Therefore, it can be understood that the required tension set of the cleaning blade is 5% or less, and more preferably 2% or less from the viewpoint of suppression of the partial breakage of the blade edge.

(H) Hardness of Cleaning Blade (H-1) An experiment was performed to determine a situation of occurrence of noises with various values of the hardness of the cleaning blade at the room temperature and various values of the surface moving speed of the photosensitive member.

In this experiment, an image forming apparatus of the type shown in FIG. 1 was used as a copying machine operating at a copying speed of 76 sheets per minute, and the situation of occurrence of noises was determined during copying of $10^5$ A4-size sheets under the environmental temperature of 25° C. and humidity of 50% RH. In this experiment, the impact resilience of the cleaning blade at the room temperature was in a range from 7 to 61%, the blade pressure against the photosensitive member was 2 g/mm, and the absolute value of the charge amount of residual toner was about 10 μC/g. The hardness of the cleaning blade was varied by selecting various kinds of materials of polyurethane such as adipate-contained and caprolactam-contained materials, and (or) by changing the manufacturing methods and conditions.

Figure 11:
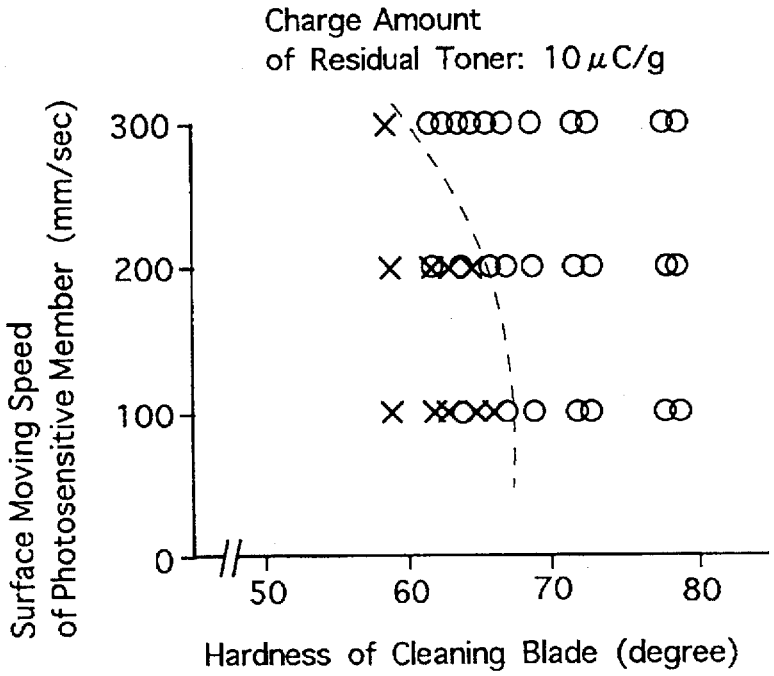
FIG. 11 shows a result of an experiment for determining a relationship between a hardness of a cleaning blade, a surface moving speed of a photosensitive member and a situation of noise generation.

A result of the experiment is shown in FIG. 11. In FIG. 11, "O" represents that no noises occurred, and "X" represents that noises occurred.

According to the figure, it can be understood that the cleaning blade having the hardness of 60 degrees or more caused noises when the surface moving speed of the photosensitive member was 100 mm/sec or 200 mm/sec, but did not cause noises when the surface moving speed of the photosensitive member was 300 mm/sec. In a high-speed image forming apparatus such as a high-speed copying machine, the surface moving speed of the photosensitive member during a continuous operation is usually about 300 mm/sec. Therefore, the cleaning blade having the hardness of 60 degrees or more can prevent a practical problem relating to noises. If the hardness of the cleaning blade was 66 degrees or more, noises did not occur even when the surface moving speed of the photosensitive member was 200 mm/sec. If the hardness of the cleaning blade was 68 degrees or more, noises did not occur even when the surface moving speed of the photosensitive member was 100 mm/sec. It can be understood from these facts that the cleaning blade having the hardness of 68 degrees or more can be applied to any process speed of the image forming apparatus. The process speed of the image forming apparatus corresponds to the surface moving speed of the photosensitive member.

As can be understood from the foregoing, generation of noises can be suppressed more effectively with increase in cleaning blade hardness of 60 degrees or more. This can be considered as follows. As the hardness of the cleaning blade increases, the nip width of the edge of the cleaning blade decreases, so that a vibration in directions other than the surface moving direction of the photosensitive member does not substantially occur, so that noises can be suppressed.

An experiment for the cleaning blade hardness of 80 degrees or more was not performed. However, it can be estimated that the cleaning performance decrease as the hardness of the blade increases from 80 degrees, so that the hardness of the cleaning blade is desirably 80 degrees or less.

(H-2) An experiment was performed to determine the amount of wear of the blade edge and the situation of occurrence of toner unwiping with various values of hardness of the cleaning blade at the room temperature.

In this experiment, an image forming apparatus of the type shown in FIG. 1 was used as a copying machine operating at a copying speed of 76 sheets per minute, and a worn sectional area of the blade edge and occurrence of unwiping of the toner were determined after copying of $10^5$ A4-size sheets under an environmental temperature of 25° C. and humidity of 50% RH. The worn sectional area was measured by observing the surface of the blade edge with a scanning electron microscope. The blade pressure against the photosensitive member was set to 3.0 g/mm, and the absolute value of charge amount of the residual toner was set to about 10 μC/g. The hardness of the cleaning blade was varied by selecting various kinds of materials of polyurethane such as adipate-contained and caprolactam-contained materials, and (or) by changing the manufacturing methods and conditions.

Figure 12:
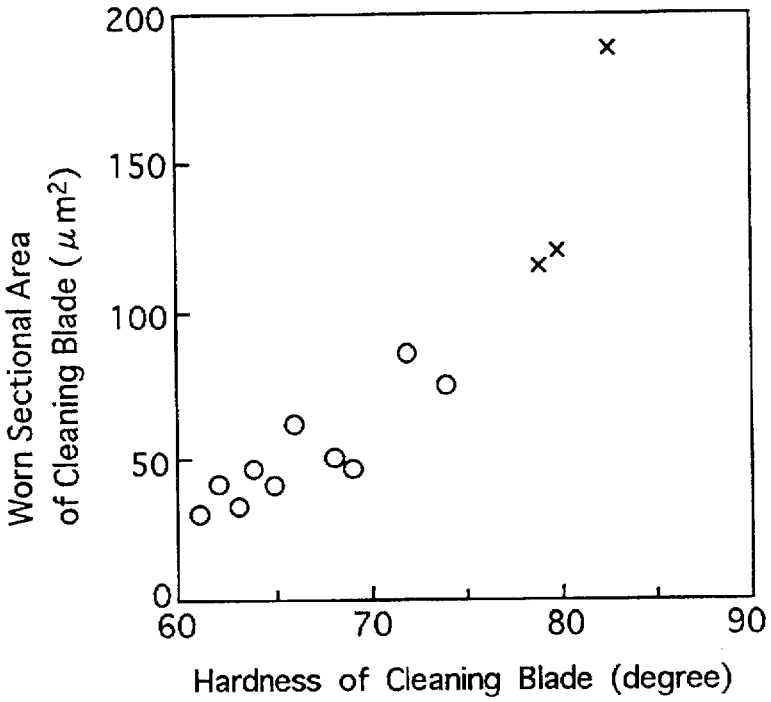
FIG. 12 shows a result of an experiment for determining a relationship between a hardness of a cleaning blade, an amount of wear of a blade edge and a situation of occurrence of unwiping of toner.

A result of the experiment is shown in FIG. 12. In FIG. 12, "O" represents that no unwiping of the toner occurred, and "X" represents that unwiping of the toner occurred.

It can be understood from the figure that the worn sectional area of the blade edge increases in accordance with increase in hardness. The reason for this can be considered that a larger hardness reduces a toughness. It can also be seen that unwiping of the toner did not occur with the hardness from 61 to 73 degrees. Unwiping of the toner started to occur when the hardness substantially exceeded 80 degrees.

Although not shown, when the hardness of the blade was smaller than 60 degrees, unwiping of the toner started to occur at an initial stage of the continuous copying operation. The reason for this can be considered that the blade lost its toughness due to an excessively small hardness, and therefore a suppressing force against the toner decreased.

A similar experiment was performed with the pressure of the cleaning blade against the photosensitive member selectively set to 0.5 g/mm and 5.0 g/mm. Although the worn sectional area differed from the above result, a result similar to that in FIG. 12 was obtained with respect to the unwiping.

A similar experiment was also performed with different environmental temperatures and different copying speeds of the image forming apparatus. In either case, a similar result was obtained with respect to the unwiping, although the worn sectional area differed from the foregoing.

Accordingly, it can be understood that the preferable hardness of the cleaning blade is generally in a range from 60 to 80 degrees, and more preferably in a range from 65 to 75 degrees from the viewpoint of suppression of noises and wearing of the blade as well as the cleaning performance.

(I) Average Particle Diameter of After-Treatment Agent

An experiment was performed with various values of the average particle diameter of the after-treatment agent which was added to the toner, e.g., for improving fluidity of the toner, and more specifically, the experiment was performed by performing continuous image formation of up to 1000 sheets and thereby determining the number of sheets at which foreign matters started to be adhered onto the surface of the photosensitive member.

In this experiment, the toner had an average particle diameter of 8 μm, the absolute value of the charge amount of the toner was between 20 and 40 μC/g, and the cleaning blade was made of a caprolactam-contained urethane rubber having an impact resilience of 39%. The after-treatment agent was selected from materials containing silicon, titanium and aluminum. The average particle diameter of the after-treatment agent was directly measured in some case, and was calculated from a specific surface area with respect to the toner in the other cases.

Figure 13:
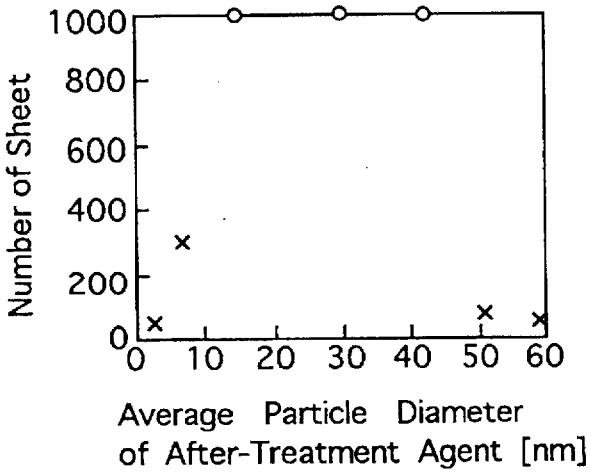
FIG. 13 shows a result of an experiment for determining a relationship between an average particle diameter of after-treatment agent and a situation of adhesion of foreign matters to a photosensitive member surface.

A result of the experiment is shown in FIG. 13. In FIG. 13, "X" represents that adhesion of foreign matters onto the surface of the photosensitive member was observed directly by eyes or with an optical microscope of a magnification of 200 times. "O" represents that adhesion of foreign matters was not observed even with the optical microscope of a magnification of 200 times.

It can be understood from the figure that an average particle diameter of the after-treatment agent smaller than 5 nm or larger than 50 nm caused adhesion of foreign matters after image forming of 100 or fewer sheets. When the average particle diameter of the after-treatment agent is in a range from 10 to 40 nm, adhesion of foreign matters did not occur. The reason for this can be considered as follows. If the average particle diameter of the after-treatment agent was excessively large, component of the after-treatment agent was rubbed and stuck onto the photosensitive member surface due to a stronger pressure against the particles, when the after-treatment agent entered a space between the cleaning blade and the photosensitive member surface. If the average particle diameter of the after-treatment agent was excessively small, a sticking force between particles significantly increased, so that an apparent average particle diameter increased due to condensation, thereby a phenomenon similar to the case of a large average particle diameter occurred.

Accordingly, the preferable average particle diameter of the after-treatment agent is generally in a range from 5 to 50 nm, and more preferably in a range from 10 to 40 nm from the viewpoint of suppression of adhesion of foreign matters onto the photosensitive member surface.

(J) Thickness of Cleaning Blade

An experiment was performed to determine a situation of unwiping of the toner on the photosensitive member surface and a situation of occurrence of tear-off or the like of the cleaning blade with various values of the thickness of the cleaning blade.

In this experiment, the pressure of the cleaning blade was 2 g/mm, the pressing angle was 10 degrees, the absolute value of charge amount of the residual toner was 20 μC/g, and the average particle diameter of the toner was 8 μm.

A result of the experiment was shown in the following table 3. In the table 3, "O" represents that good cleaning was performed, and "X" represents that good cleaning was not performed, and unwiping of the toner, tear-off of the cleaning blade or the like occurred.

TABLE 3

| Thickness of Cleaning Blade (mm) | | | | | | |
|---|---|---|---|---|---|---|
| 0.6 | 0.8 | 1.0 | 1.2 | 1.4 | 1.6 | 1.8 |
| X | X | O | O | O | O | O |

The following can be understood from the table 3. If the cleaning blade had a thickness smaller than about 1 mm, unwiped of the toner and/or tear-off of the blade occurred. The reason for this can be considered that the cleaning blade having an excessively small thickness could not have a sufficient strength.

Accordingly, it can be understood that the preferable thickness of the cleaning blade is 1 mm or more from the viewpoint of suppression of tear-off of the blade and the cleaning performance.

(K) Shaft Torque of Photosensitive Member

An experiment was performed to determine a shaft torque causing tear-off of the cleaning blade with the pressure of the cleaning blade changing from 2 g/mm to 6 g/mm and thereby with various values of shaft torque exerted on the photosensitive member.

In this experiment, the pressing angle of the cleaning blade was 10 degrees, the average particle diameter of the residual toner was 8 μm, and the absolute value of charge amount of the residual toner was 20 μC/g.

Figure 14:
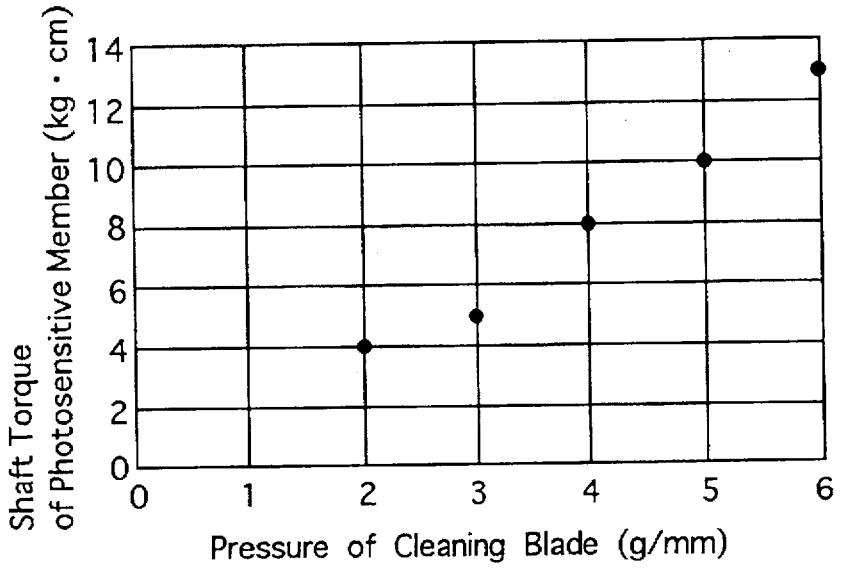
FIG. 14 shows an example in which a pressure of a cleaning blade is varied to vary a shaft torque exerted on a photosensitive, member for determining a relationship between the shaft torque and occurrence of tear-off of the cleaning blade.

A result of the experiment was shown in FIG. 14.

According to this experiment, tear-off of the cleaning blade occurred when the shaft torque exceeded 10 kg·cm. Therefore, the appropriate shaft torque exerted on the rotary image carrying member such as a photosensitive drum is 10 kg·cm or less, and more preferably 7 kg·cm or less.

(L) Tensile Strength of Cleaning Blade

An experiment was performed with various values of a tensile strength of the cleaning blade for determining the number of operations (i.e., the number of sheets) at which unwiping of the residual toner started, and in other words the number of operations (i.e., the number of sheets) which allowed good cleaning.

This experiment was performed under the conditions that the pressure of the cleaning blade was 2 g/mm, and the absolute value of the charge amount of the residual toner was 20 μC/g.

Figure 15:
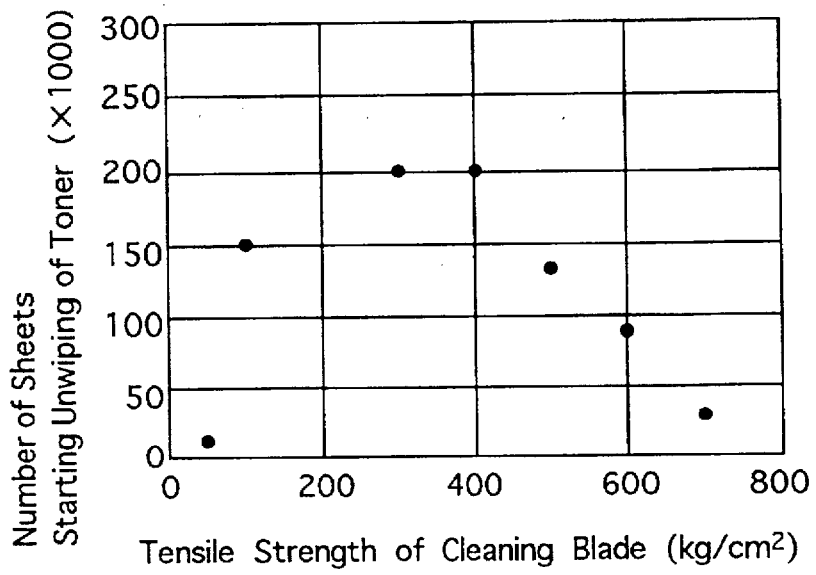
FIG. 15 shows a result of an experiment for determining a relationship between a tensile strength of a cleaning blade and a number of sheets starting unwiping of toner.

A result of the experiment is shown in FIG. 15.

It can be understood from the figure that the number of sheets starting the unwiping of toner remarkably decreased when the tensile strength of the cleaning blade was smaller than 100 kg/cm$^2$. The reason for this can be considered that the tensile strength lower than 100 kg/cm$^2$ was liable to cause partial breakage of the edge of the cleaning blade. It can be also understood that the tensile strength larger than 600 kg/cm$^2$ reduced the number of sheets starting the unwiping of toner. The reason for this can be considered that the tensile strength of the cleaning blade larger than 600 kg/cm$^2$ increased the amount of wear of the blade.

Therefore, the tensile strength of the cleaning blade is preferably in a range from 100 to 600 kg/cm$^2$, and more preferably in a range from 100 to 450 kg/cm$^2$ from the viewpoint of the number of sheets allowing good cleaning performance.

From the results of experiments already described and others, in the image forming apparatus shown in FIG. 1, the amount of wear of the photosensitive drum 11 can be suppressed to a practically allowed extent by setting the degree of toluene swelling of the cleaning blade 611 in a range from 20 to 100%. In contrast to the prior art, special processing and control steps are not required for manufacturing the cleaning blade, and a simple mechanism can be employed for pressing the cleaning blade against the photosensitive drum. Therefore, the cleaning device 61 and the image forming apparatus can be inexpensive.

In the image forming apparatus shown in FIG. 1, when the pressure of the cleaning blade 611 against the photosensitive drum 11 is set in a range from 0.5 to 5 g/mm, the impact resilience of the blade 611 is set in a range from 10 to 65% (more preferably, 40 to 60%), the Young's modulus of the blade 611 is set in a range from 30 to 120 kg/cm$^2$ (more preferably, 30 to 80 kg/cm$^2$), and the 300%-modulus of the blade 611 is set in a range from 100 to 600 kg/cm$^2$ (more preferably, 150 to 600 kg/cm$^2$), partial breakage of the edge of the blade as well as wearing of the blade and photosensitive member can be suppressed while maintaining a practically sufficient cleaning performance.

By setting the other physical properties of the cleaning blade 611 and others in the ranges already described, the cleaning performance can be further improved. The image forming apparatus according to the invention is not restricted to that shown in FIG. 1, but can have various forms described below. In any case, by setting the physical properties of the cleaning blade and others in the foregoing ranges, the cleaning performance can be improved, and various disadvantages such as wearing can be suppressed or reduced.

In the image forming apparatus shown in FIG. 1, the image carrying member is an organic photosensitive member including a cylindrical aluminum tube, over which a charge generating layer made of bis-azo pigment and binder resin, and a charge transporting layer made of hydrazone derivative and polycarbonate resin are layered in this order. Alternatively, such an organic photosensitive member may be used that includes a cylindrical oxidized aluminum tube, over which a charge generating layer made of phthalocyanine pigment and binder resin, and a charge transporting layer made of a hydrazone derivative and polycarboriate resin are layered in this order. The organic photosensitive member may selectively have various structures, in which a charge generating layer, a charge transporting layer and an overcoat layer are formed over an electrically conductive substrate, in which a charge generating layer and a charge transporting layer are layered in the opposite order, and in which an undercoat layer is arranged over a conductive substrate. As already described, as an image carrying member, arsenic selenide photosensitive member, tellurium selenide photosensitive member, selenium photosensitive member, CdS photosensitive member or amorphous silicon photosensitive member may be employed other than the organic photosensitive member. Also, it may have a structure of which surface layer is made of dielectric resin.

As the charging means, the charging roller is employed in the embodiment, another known charging means such as a Scorotron charger, a charging brush or a rotary charging brush may be employed.

As the developing device, a two-component dry developing type is employed in the embodiment, another type of the developing device such as one-component dry developing type using only toner powder, or a wet developing type using ink or isoper and pigment particles dissolved thereinto may be employed.

As the transfer means, a transfer roller is employed in the embodiment, another known transferring means such as a transfer charger may be employed.

As the separating means, the discharging probe is employed in the embodiment, another known separating means such as a separating charger may be employed.

The cleaning means, which is provided with a cleaning blade pressed against the image carrying member in the counter manner in the embodiment, may be provided with a cleaning blade pressed against the image carrying member in the trailing manner, and may be further provided with a waste toner bottle for accommodating scraped toner and (or) a transporting screw for transporting the waste toner. In addition to the cleaning blade, the cleaning means may be provided with a cleaner brush or a cleaner roller which can remove paper powder and foreign matters on the image carrying member, can scrape off the residual toner on the image carrying member, can alternatively supply the toner or the like to a portion of the image carrying member not sufficiently bearing the toner, and/or can control the charge amount of the residual toner owing to a bias power source connected thereto. The cleaning blade, which is made of polyurethane resin in the embodiments, may be made of polytetrafluoroethylene or the like.

The image forming apparatus of the invention may be provided with discharging means such as a before-cleaner charger, which is employed for controlling the surface electric potential of the image carrying member before cleaning and the charge amount of the toner, and (or) discharging means such as a photo-discharging device.

The image forming apparatus of the invention can selectively have various structures by selecting combinations of the image carrying member and others described above. Examples are shown in FIGS. 16 to 19, which show schematic structures of the other examples of the image forming apparatus according to the invention.

Figure 16:
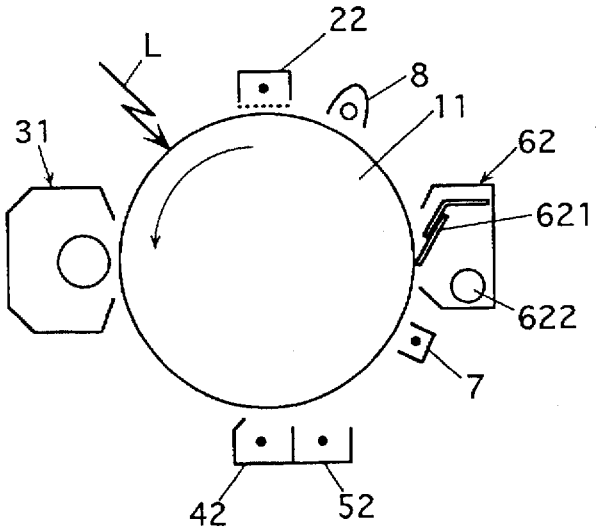
FIG. 16 shows a schematic structure of an image forming apparatus of another embodiment.

The image forming apparatus in FIG. 16 includes, as the image carrying member, the organic photosensitive drum 11 which is the same as that shown in FIG. 1. Around the photosensitive drum 11, there are arranged a Scorotron charger 22, the developing device 31, a transfer charger 42, a separating charger 52, a before-cleaner charger 7, a cleaning device 62 which includes a cleaning blade 621 pressed against the photosensitive drum 11 in the counter manner and a transporting screw 622, and an optical discharging device 8. A record image light L is of a positive type, and is radiated through a space between the charger 22 and the developing device 31.

In the image forming apparatus shown in FIG. 16, the toner, which was not transferred onto the record member and remains on the photosensitive drum 11, is removed by the cleaning device 62 after the charge amount of the residual toner is controlled by the cleaner-before charger 7 supplying AC voltage biased with DC voltage. Likewise, toner patterns and other which are formed on the photosensitive drum 11 for image adjustment are removed by the cleaning device 62.

Figure 17:
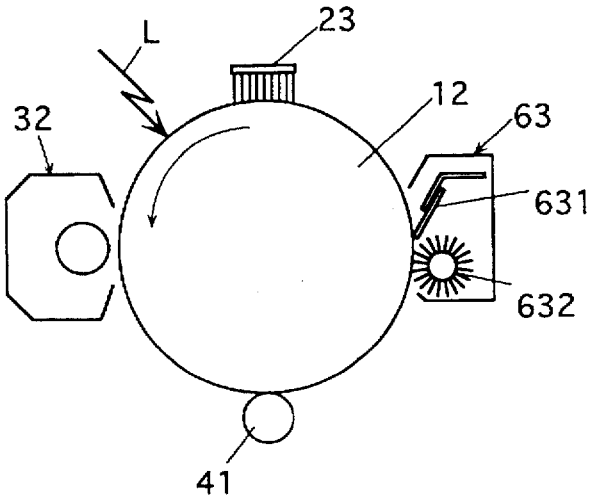
FIG. 17 shows a schematic structure of an image forming apparatus of still another embodiment.

The image forming apparatus in FIG. 17 includes a photosensitive member 12 in a drum form as an image carrying member. Around the photosensitive member 12, there are arranged a charging brush 23, the developing device 32, the transfer roller 41, and a cleaning device 63 which is provided with a cleaning blade 631 pressed against the photosensitive drum 12 in the counter manner and a cleaner brush 632. A record image light L is radiated through a space between the charging brush 23 and the developing device 32.

The photosensitive drum 12 is an organic photosensitive member (OPC) including a cylindrical oxidized aluminum tube, over which a charge generating layer of 1 μm or less in thickness made of phthalocyanine pigment and binder resin, and a charge transporting layer of about 20 μm in thickness made of a hydrazone derivative and polycarbonate resin are layered in this order.

The developing device 32 is of a two-component dry developing type using negatively charged non-magnetic toner powder and magnetic carrier. Based on an electrostatic latent image, which is prepared by radiating the negative record image light L onto the negatively charged photosensitive drum 12, the developing device 32 forms a toner image corresponding to the record image on the photosensitive drum 12. The developing device 32 uses the toner of the polarity opposite to that of the developing device 31 used in FIGS. 1 and 16. The cleaner brush 632 is connected to a bias power source (not shown), so that it can control the charge amount of the residual toner on the photosensitive drum 12, and thus has a function similar to that of the cleaner-before charger 7 shown in FIG. 16.

Figure 18:
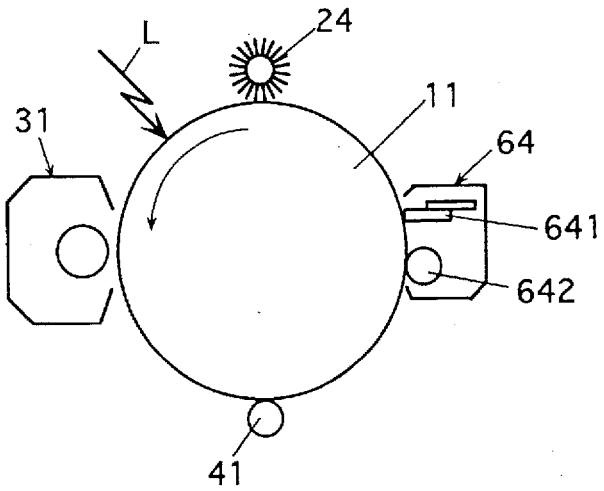
FIG. 18 shows a schematic structure of an image forming apparatus of yet another embodiment.

The image forming apparatus in FIG. 18 includes, as an image carrying member, an organic photosensitive drum 11 which is the same as that shown in FIG. 1. Around the photosensitive drum 11, there are arranged a rotary charging brush 24, the developing device 31, the transfer roller 41, and a cleaning device 64 which is provided with a cleaning blade 641 pressed against the photosensitive drum 11 in the trailing manner and a cleaner roller 642. A record image light L is radiated through a space between the rotary charging brush 24 and the developing device 31.

The cleaner roller 642 is connected to a bias power source (not shown), so that it can control the charge amount of the residual toner on the photosensitive drum 11, and thus has a function similar to that of the cleaner-before charger 7 shown in FIG. 16.

Figure 19:
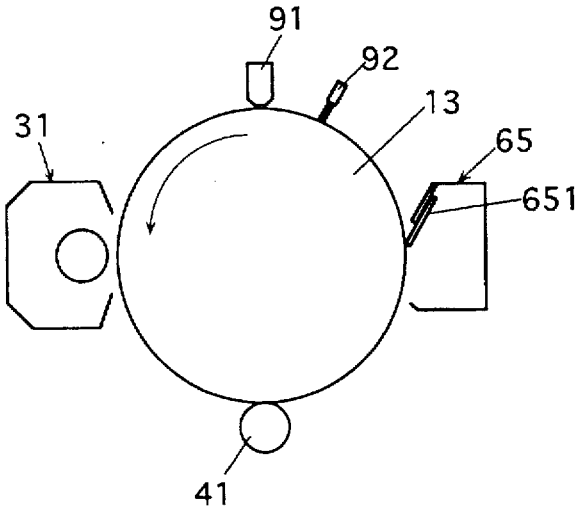
FIG. 19 shows a schematic structure of an image forming apparatus of further another embodiment.

The image forming apparatus in FIG. 19 includes a dielectric member 13 of a drum form as an image carrying member. Around the dielectric drum 13, there are arranged a record electrode 91, the developing device 31, the transfer roller 41, a cleaning device 65 which is provided with a cleaning blade 651 pressed against the dielectric drum 13 in the counter manner, and a discharging brush 92. The dielectric drum 13 includes an aluminum tube coated with a dielectric resin material. In this image forming apparatus, the record electrode 91 forms an electrostatic latent image on the dielectric drum 13.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus which is operable to form an electrostatic latent image on an image carrying member, develop said latent image with toner into a visible toner image, transfer said toner image onto a record member and fix the same, and includes a cleaning device including a cleaning blade having an edge pressed against said image carrying member with a predetermined pressure for removing residual toner on said image carrying member after the transfer, wherein a degree of toluene swelling of said cleaning blade is in a range from 20% to 100%.

2. The image forming apparatus according to claim 1, wherein said cleaning blade has an impact resilience in a range from 10% to 65%.

3. The image forming apparatus according to claim 1, wherein said predetermined pressure of said cleaning blade is in a range from 0.5 to 5 g/mm.

4. The image forming apparatus according to claim 2, wherein said predetermined pressure of said cleaning blade is in a range from 0.5 to 5 g/mm.

5. An image forming apparatus which is operable to form an electrostatic latent image on an image carrying member, develop said latent image with toner into a visible toner image, transfer said toner image onto a record member and fix the same, and includes a cleaning device including a cleaning blade having an edge pressed against said image carrying member with a predetermined pressure for removing residual toner on said image carrying member after the transfer, wherein said pressure of said cleaning blade against said image carrying member is in a range from 0.5 to 5 g/mm, said cleaning blade has an impact resilience in a range from 10 to 65%, said cleaning blade has a Young's modulus in a range from 30 to 120 kg/cm$^2$, and said cleaning blade has a 300%-modulus in a range from 100 to 600 kg/cm$^2$.

6. The image forming apparatus according to claim 5, wherein said cleaning blade has a degree of toluene swelling of 100% or less.

7. The image forming apparatus according to claim 5, wherein said cleaning blade has a tension set of 5% or less.

8. The image forming apparatus according to claim 5, wherein said cleaning blade has a hardness in a range from 60 to 80 degrees.

9. The image forming apparatus according to claim 5, wherein said cleaning blade has a tensile strength in a range from 100 to 600 kg/cm$^2$.

10. The image forming apparatus according to claim 5, wherein said cleaning blade has a thickness of 1 mm or more.

11. The image forming apparatus according to claim 5, wherein a pressing angle of said cleaning blade with respect to said image carrying member is in a range from 5 to 20 degrees.

12. The image forming apparatus according to claim 5, wherein the toner adhering to said image carrying member has an average particle diameter in a range from 3 to 15 μm and a charge amount in a range from 5 to 50 μC/g in absolute value.

13. The image forming apparatus according to claim 5, wherein said toner contains after-treatment agent added thereto and having an average particle diameter in a range from 5 to 50 nm.

14. The image forming apparatus according to claim 5, wherein a torque of 10 kg·cm or less is exerted on said image carrying member.

15. The image forming apparatus according to claim 5, wherein said cleaning blade has a length of L (cm), and a force in a range from 0.005 L to 0.057 L (kg) is exerted on said image carrying member.

16. A cleaning blade employed in an image forming apparatus which is operable to form an electrostatic latent image on an image carrying member, develop said latent image with toner into a visible toner image, transfer said toner image onto a record member and fix the same, and having an edge pressed against said image carrying member with a predetermined pressure for removing residual toner on said image carrying member after the transfer, wherein a degree of toluene swelling of said cleaning blade is in a range from 20% to 100%.

17. The cleaning blade according to claim 16, wherein said cleaning blade has an impact resilience in a range from 10% to 65%.

18. A cleaning blade employed in an image forming apparatus which is operable to form an electrostatic latent image on an image carrying member, develop said latent image with toner into a visible toner image, transfer said toner image onto a record member and fix the same, and having an edge pressed against said image carrying member with a predetermined pressure for removing residual toner on said image carrying member after the transfer, wherein said cleaning blade has:

an impact resilience in a range from 10% to 65%, a Young's modulus in a range from 30 to 120 kg/cm$^2$, and a 300%-modulus in a range from 100 to 600 kg/cm$^2$.

19. The cleaning blade according to claim 18, wherein said cleaning blade has a degree of toluene swelling of 100% or less.

20. The cleaning blade according to claim 18, wherein said cleaning blade has a tension set of 5% or less.

21. The cleaning blade according to claim 18, wherein said cleaning blade has a hardness in a range from 60 to 80 degrees.

22. The cleaning blade according to claim 18, wherein said cleaning blade has a tensile strength in a range from 100 to 600 kg/cm$^2$.

23. The cleaning blade according to claim 18, wherein said cleaning blade has a thickness of 1 mm or more.

* * * * *